US010482805B2

(12) United States Patent
Lin et al.

(10) Patent No.: US 10,482,805 B2
(45) Date of Patent: Nov. 19, 2019

(54) DISPLAY CONTROLLER AND DISPLAY DRIVING APPARATUS INCLUDING THE SAME

(71) Applicant: Samsung Electronics Co., Ltd., Suwon-si, Gyeonggi-do (KR)

(72) Inventors: Chiahsin Lin, Taipei (TW); Jae Yoon Kim, Seoul (KR); Stanley Liao, Taepei (TW)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 87 days.

(21) Appl. No.: 15/688,230

(22) Filed: Aug. 28, 2017

(65) Prior Publication Data

US 2018/0226009 A1 Aug. 9, 2018

(30) Foreign Application Priority Data

Feb. 9, 2017 (KR) ..... 10-2017-0018246

(51) Int. Cl.

*G09G 3/36* (2006.01)
*G09G 3/20* (2006.01)
*G09G 3/3275* (2016.01)

(52) U.S. Cl.

CPC ..... *G09G 3/2003* (2013.01); *G09G 3/20* (2013.01); *G09G 3/3275* (2013.01); *G09G 3/3685* (2013.01); *G09G 2300/0408* (2013.01); *G09G 2300/0465* (2013.01); *G09G 2310/027* (2013.01); *G09G 2310/0248* (2013.01); *G09G 2310/0264* (2013.01); *G09G 2310/0267* (2013.01); *G09G 2310/0291* (2013.01); *G09G 2330/021* (2013.01); *G09G 2370/08* (2013.01)

(58) Field of Classification Search

CPC ... G09G 2310/0248; G09G 2310/0291; G09G 2310/08
USPC ..... 345/99–100
See application file for complete search history.

(56) References Cited

U.S. PATENT DOCUMENTS

2002/0196218 A1* 12/2002 Ham ..... G09G 3/3611 345/87
2006/0197733 A1* 9/2006 Lee ..... G09G 3/3648 345/100
2009/0219265 A1* 9/2009 Lee ..... G09G 3/3291 345/205

* cited by examiner

*Primary Examiner* — Roy P Rabindranath
(74) *Attorney, Agent, or Firm* — Harness, Dickey & Pierce, P.L.C.

(57) ABSTRACT

A display controller comprises a buffer configured to store first pixel data input to a source line during a first period, and second pixel data input to the source line during a second period, subsequent to the first period, and a data generating unit configured to generate control data by comparing each of the first pixel data and the second pixel data with desired reference data, and transfer the second pixel data and the control data to a source driver driving the source line.

19 Claims, 12 Drawing Sheets

DISPLAY CONTROLLER AND DISPLAY DRIVING APPARATUS INCLUDING THE SAME

CROSS-REFERENCE TO RELATED APPLICATION

This U.S. non-provisional application claims the benefit of priority under 35 U.S.C. § 119 to Korean Patent Application No. 10-2017-0018246, filed on Feb. 9, 2017 in the Korean Intellectual Property Office (KIPO), the disclosure of which is incorporated herein by reference in its entirety.

BACKGROUND

1. Field

Various example embodiments relate to a display controller, and/or a display driving apparatus and/or a display driving system including the same. Additionally, various example embodiments relate to a method and/or non-transitory computer readable medium for operating the display controller.

2. Description of Related Art

As flat panel display devices are used for in electronic devices for displaying an image such as TVs, laptop computers, monitors, mobile devices, and the like, liquid crystal display (LCD) device, organic light emitting device (OLED), and the like are used for the flat panel display. A flat panel display device may include a panel having a plurality of pixels, and a driving device for applying an electrical signal to the plurality of pixels. In addition, an image may be implemented by an electric signal which the driving device supplies to the plurality of pixels. In order to increase mobile device usage times and reduce the power consumption of the mobile device to benefit the issue of environmental friendliness, various studies have been conducted regarding reducing the power consumption of display devices.

SUMMARY

An aspect of the present inventive concepts may provide a display controller operated with low power consumption and having a small layout area, and a display driving apparatus including the same.

According to at least one example embodiment of the present inventive concepts, a display controller includes a buffer configured to store first pixel data input to a source line during a first period, and second pixel data input to the source line during a second period, the second period being subsequent to the first period, and a data generating circuit configured to generate control data by comparing each of the first pixel data and the second pixel data with desired reference data, and transfer the second pixel data and the control data to a source driver driving the source line.

According to at least one example embodiment of the present inventive concepts, a display driving apparatus includes a display controller configured to compare each of first pixel data corresponding to a first source voltage and second pixel data corresponding to a second source voltage with reference data, and generate control data based on results of the comparison, wherein the first source voltage is input to a source line during a first period and the second source voltage is input to the source line during a second period, subsequent to the first period, and a source driver configured to input an intermediate voltage corresponding to the reference data to the source line during a portion of the second period, in response to the control data having a desired logic value.

According to at least one example embodiment of the present inventive concepts, a display driving apparatus includes a display controller configured to store first pixel data and second pixel data, the second pixel data received after the first pixel data, and generate control data related to a precharge operation or a recycle operation based on the first pixel data, the second pixel data, and desired reference data, a source driver configured to receive the control data and drive a source line based on the control data, and a display panel configured to output the second pixel data based on the source line.

BRIEF DESCRIPTION OF DRAWINGS

The foregoing and other features of inventive concepts will be apparent from the more particular description of non-limiting example embodiments of inventive concepts, as illustrated in the accompanying drawings in which like reference characters refer to like parts throughout the different views. The drawings are not necessarily to scale, emphasis instead being placed upon illustrating principles of inventive concepts. In the drawings.

DETAILED DESCRIPTION

Various example embodiments of the present inventive concepts will now be described in detail with reference to the accompanying drawings.

Figure 1:
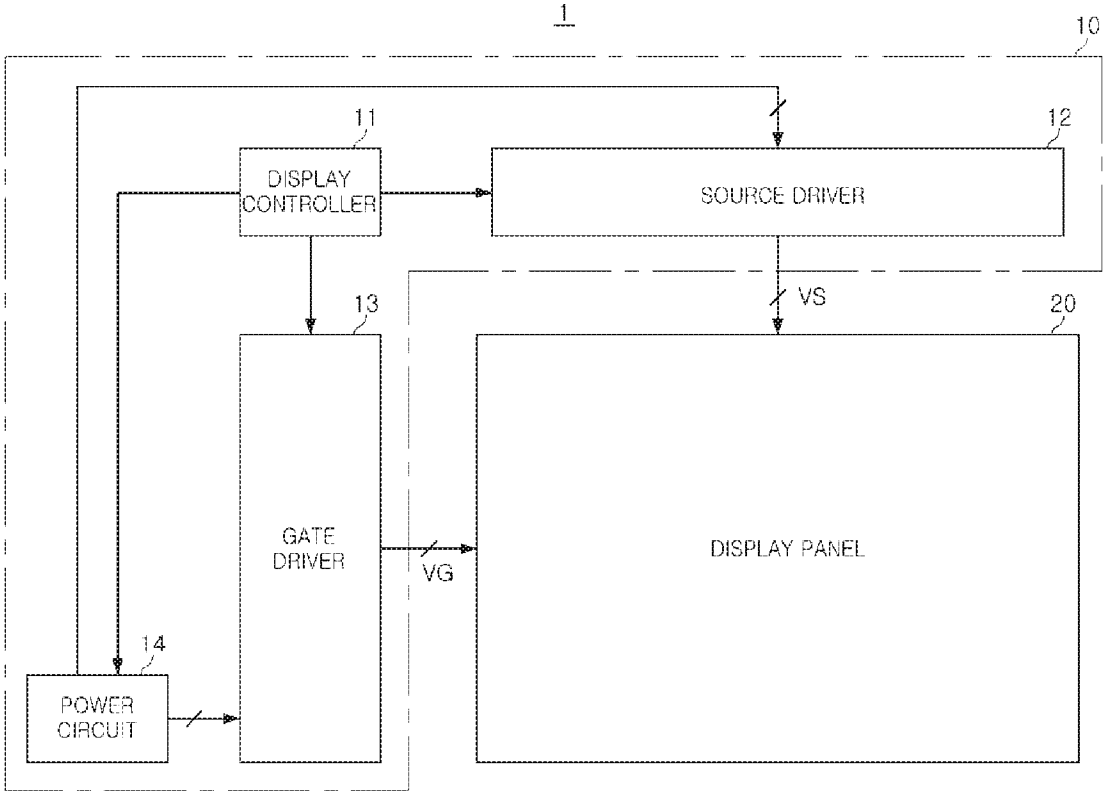
FIGS. 1 and 2 are block diagrams schematically illustrating a display device including a display driving apparatus according to some example embodiments.
Figure 2:
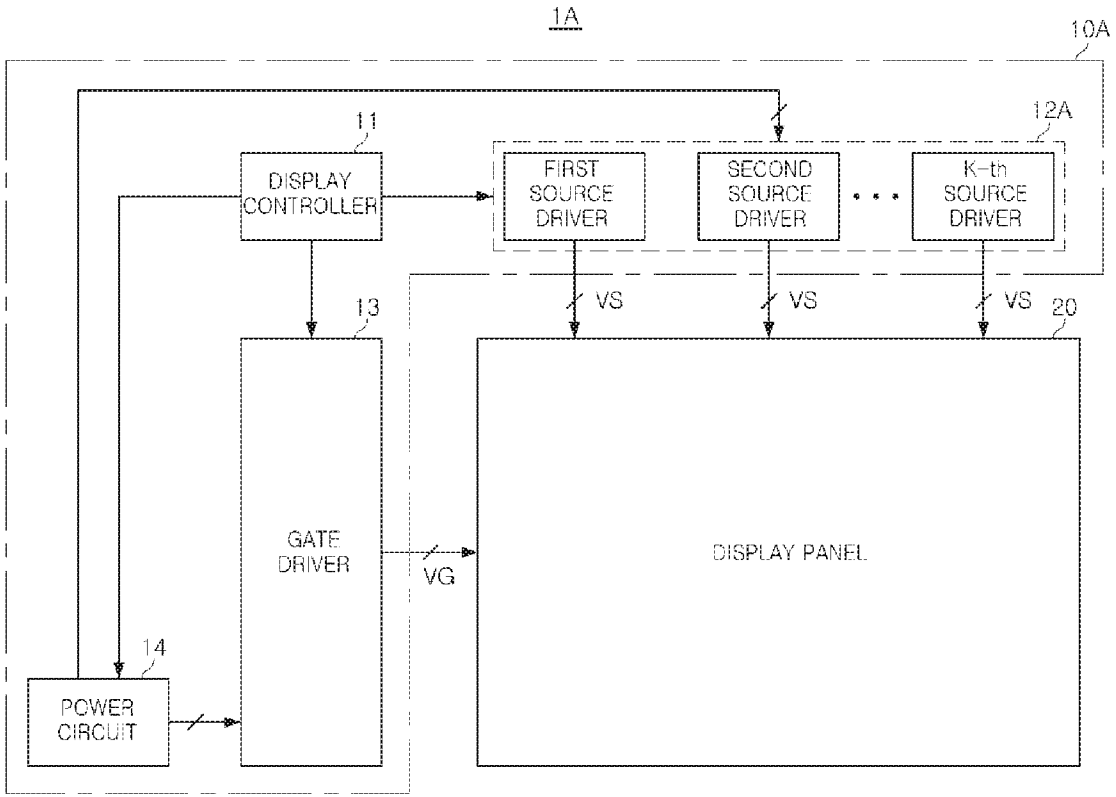

FIGS. 1 and 2 are views provided to illustrate a display device including a display driving apparatus according to some example embodiments.

First, with reference to FIG. 1, a display device 1 according to at least one example embodiment may include a display controller 11, a source driver 12, a gate driver 13, a power circuit 14, and a display panel 20, but is not limited thereof. The display controller 11, the source driver 12, the gate driver 13, and the power circuit 14 may be included in a display driving apparatus 10.

The display panel 20 may include at least one transparent substrate, and a plurality of gate lines and a plurality of source lines may be disposed on the at least one transparent substrate to intersect each other. A plurality of pixels may be defined at intersection points of the plurality of gate lines and the plurality of source lines. Each pixel may include a transistor and a capacitor, while a gate electrode and a source electrode of the transistor may be connected to a gate line and a source line, respectively. The capacitor may be connected to a drain electrode of the transistor, and may include a storage capacitor. When the display device 1 is a liquid crystal display (LCD) device, a liquid crystal capacitor may be further connected, in addition to the storage capacitor.

The display controller 11 may receive image data transferred from an external source and/or may generate image data based on a control signal transferred from an external source, or the like. The display controller 11 may generate a signal for controlling the timing for when the source driver 12 and the gate driver 13 drive a plurality of source lines and a plurality of gate lines, respectively.

The gate driver 13 may sequentially scan a plurality of gate lines based on at least one control signal transferred from the display controller 11. In at least one example embodiment, the gate driver 13 may select at least one of the plurality of gate lines, and thus may input a gate power supply voltage VG to the selected gate line(s). In addition, a gate line receiving the gate power supply voltage VG may be activated. The source driver 12 may input a source voltage VS, for displaying an image, to a source line intersecting the gate line, activated by the gate power supply voltage VG.

The source driver 12 may output the source voltage VS based on at least one control signal transferred by the display controller 11, and thus may drive a plurality of source lines based on the at least one control signal. The source voltage VS is an analog signal desired and/or required to display an image on the panel 20, and may be a gradation voltage. The source voltage VS may be applied to a source line intersecting a gate line activated by receiving the gate power supply voltage VG by the gate driver 13. Thus, an image may be displayed in the order in which the gate driver 13 scans a gate line, that is, in a horizontal line unit of the panel 20.

The power circuit 14 may generate various internal power supply voltages desired and/or required for an operation of the display device 1 based on an external power supply voltage supplied from an external source. The internal power supply voltage may be a plurality of voltages having different values, but is not limited thereto. The power circuit 14 may include a charge pump circuit for generating the internal power supply voltage, or the like. In at least one example embodiment, the power circuit 14 may generate a gate power supply voltage VG desired and/or required to drive a gate line based on an external power supply voltage. At least a portion of the gate power supply voltage VG may have a value different from that of the external power supply voltage.

Next, with reference to FIG. 2, a display device 1A according to at least one example embodiment may include a display driving apparatus 10A and a display panel 20. In the at least one example embodiment illustrated in FIG. 2, a source driver 12A of the display driving apparatus 10A may include first to K-th source drivers. The first to K-th source drivers may be disposed in parallel in the source driver 12A, and each of the first to K-th source drivers may allow source lines different from each other to be driven. The display device 1A according to the at least one example embodiment illustrated in FIG. 2 may correspond to the case in which a size is relatively larger than the display device 1 according to the at least one example embodiment illustrated in FIG. 1 or the resolution is high.

Figure 3:
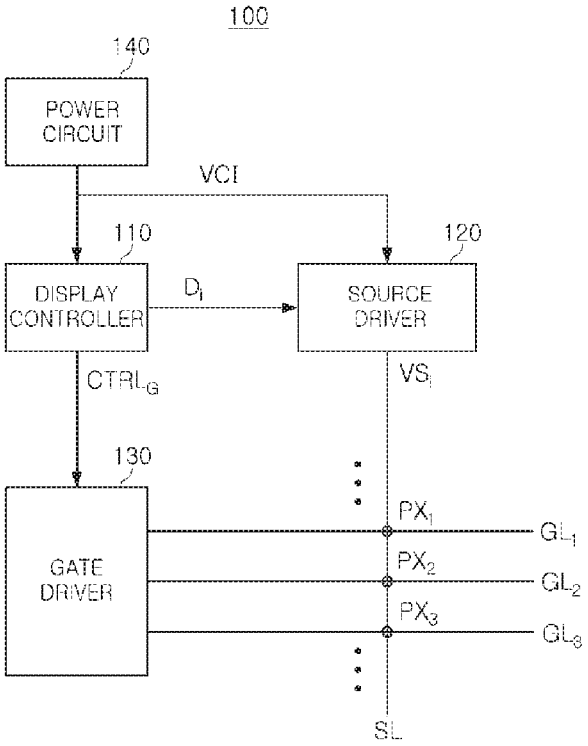
FIG. 3 is a block diagram schematically illustrating a display driving apparatus according to at least one example embodiment.

FIG. 3 is a block diagram schematically illustrating a display driving apparatus according to at least one example embodiment.

With reference to FIG. 3, a display driving apparatus 100 according to at least one example embodiment may include a display controller 110, a source driver 120, a gate driver 130, and a power circuit 140, but is not limited thereto. The display controller 110 may control operations of the source driver 120 and the gate driver 130, and the power circuit 140 may generate a voltage required for each operation of the display controller 110, the source driver 120, and the gate driver 130 and supply the voltage thereto. In at least one example embodiment, the power circuit 140 may supply an intermediate voltage VCI to the display controller 110 and the source driver 120. The intermediate voltage VCI may be higher than a ground voltage and may be lower than a power supply voltage.

The display controller 110 may transfer source data $D_i$ to the source driver 120, and the source data $D_i$ may include pixel data and control data. The source driver 120 may perform a digital-to-analog conversion on pixel data to generate source voltage $VS_i$, and may output the source voltage $VS_i$ to a source line. In at least one example embodiment, during a first period in which the gate driver 130 allows a first gate line $GL_1$ to be driven based on a gate control signal $CTRL_G$, the source voltage $VS_i$ output by the source driver 120 may be input to a first pixel $PX_1$ through a source line SL.

Meanwhile, the source driver 120 may perform a precharge and/or recycle operation based on control data included in the source data $D_i$. For example, a precharge operation may be an operation to pull up voltage of the source line SL to the intermediate voltage VCI by inputting the intermediate voltage VCI to the source line SL during a portion of a second period, when a source voltage input to the first pixel $PX_1$ is lower than the intermediate voltage VCI and a source voltage input to the second pixel $PX_2$ is higher than the intermediate voltage VCI. Meanwhile, a recycle operation may be an operation to pull down voltage of the source line SL, that is higher than the intermediate voltage VCI, to the intermediate voltage VCI by inputting the intermediate voltage VCI to the source line SL during a portion of a second period, when a source voltage input to the first pixel $PX_1$ is higher than the intermediate voltage VCI and a source voltage input to the second pixel $PX_2$ is lower than the intermediate voltage VCI.

The display controller 110 may compare first pixel data corresponding to a source voltage input to the first pixel $PX_1$ with desired (and/or predetermined) reference data, and compare second pixel data corresponding to a source voltage input to the second pixel $PX_2$ with the reference data. The display controller 110 may generate control data according to a comparison result. The expression that pixel data corresponds to source voltage may be understood to mean that data obtained by converting a source voltage into a digital value using an analog-to-digital conversion process into pixel data. In at least one example embodiment, the control data may be 1-bit digital data, and the reference data may be data obtained by converting the intermediate voltage VCI generated by the power circuit 140 into a digital value, but the example embodiments are not limited thereto. Each bit number of the first pixel data and the second pixel data may be the same as or different from reference data.

The control data may be transferred to the source driver 120 with second pixel data. In other words, control data generated by comparing each of (i)th pixel data and (i+1)th pixel data with the reference data by the display controller 110 may be transferred to the source driver 120 with (i+1)th pixel data.

In at least one example embodiment of the inventive concepts, the source driver 120 may perform a precharge and/or recycle operation during a portion of the beginning of each period. In at least one example embodiment, when control data has a high logic value, the source driver 120 may perform, a precharge and/or recycle operation. In addition, when control data has a low logic value, the source driver 120 may not perform a precharge and/or recycle operation.

In the display driving apparatus 100 according to at least one example embodiment, whether to perform a precharge and/or recycle operation of the source driver 120 may be determined in a digital domain by the display controller 110. Thus, an analog circuit for determining whether to perform a precharge and/or recycle operation may not be included in the source driver 120, and may power consumption and a circuit area of the display driving apparatus 100.

As previously described, to determine whether to perform a precharge and/or recycle operation of the source driver 120, the display controller 110 may compare each of (i)th pixel data and (i+1)th pixel data with reference data. Whether to perform a precharge and/or recycle operation may be determined according to a result of comparing each of (i)th pixel data and (i+1)th pixel data with the reference data, or in other words, the display controller 110 determines whether to instruct the source driver 120 to perform a precharge and/or recycle operation based on the (i)th pixel data, (i+1)th pixel data and the reference data. The display controller will be described in more detail with reference to FIG. 4.

Figure 4:
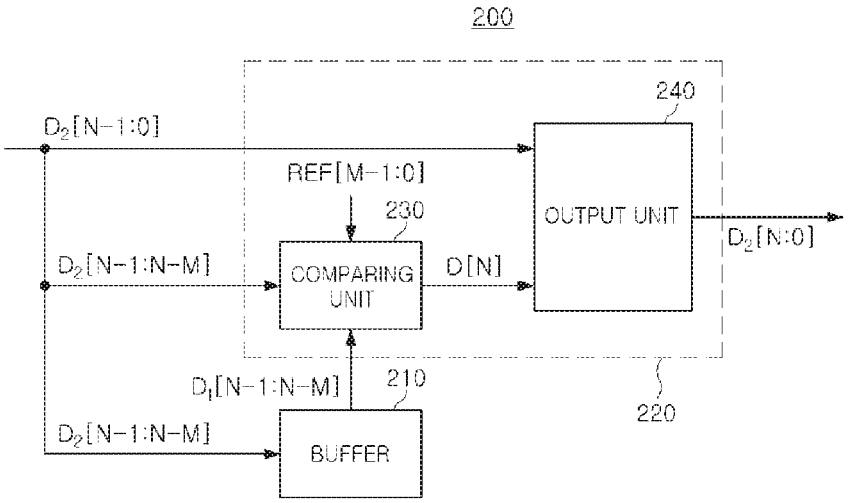
FIG. 4 is a block diagram schematically illustrating a display controller according to at least one example embodiment.

FIG. 4 is a block diagram schematically illustrating a display controller according to at least one example embodiment.

With reference to FIG. 4, a display controller 200 according to at least one example embodiment, may include a buffer 210 and a data generating unit 220 (e.g., a data generating circuit), but is not limited thereto. The data generating unit 220 may include a comparing unit 230 (e.g., a comparing circuit and/or a comparison circuit) for comparing pixel data with reference data and an output unit 240 for outputting pixel data and control data.

The display controller 200 may receive or directly generate pixel data required to display an image on a display panel, and the pixel data may correspond to source voltage input to a pixel through a source line. In other words, source voltage may be obtained through digital-to-analog conversion of the pixel data. The number of bits of the pixel data may be determined according to the resolution of the source voltage. For example, when the source voltage can have 256 values, the pixel data may be 8-bit digital data, but the example embodiments are not limited thereto. Hereinafter, for convenience of explanation, it is assumed that the pixel data is N-bit digital data, where N is a natural number.

The buffer 210 may store at least a portion of pixel data which the display controller 200 receives and/or generates. With reference to FIG. 4, the buffer 210 may transfer comparison data, e.g., first comparison data $D_1[N-1:N-M]$, which has been stored (and/or pre-stored) to the comparing unit 230, while storing at least a portion of second pixel data $D_2[N-1:0]$. The first comparison data $D_1[N-1:N-M]$ may be a selection of M number of significant bits of first pixel data, and the second comparison data $D_2[N-1:N-M]$ may be a selection of M number of significant bits of second pixel data. Each of the first pixel data and the second pixel data may be digital data corresponding to first source voltage and second source voltage. Each of first source voltage and second source voltage may be a voltage output by a source driver during each of a first period and a second period in which a gate driver allows each of a first gate line and a second gate line to be driven. The second period may come after the first period.

The comparing unit 230 may receive the first comparison data $D_1[N-1:N-M]$, the second comparison data $D_2[N-1:N-M]$, and reference data REF[M−1:0]. In at least one example embodiment, the comparing unit 230 may compare each of the first comparison data $D_1[N-1:N-M]$ and the second comparison data $D_2[N-1:N-M]$ with reference data REF[M−1:0], and thus may determine a value of control data D[N]. In other words, the comparing unit 230 may generate a control data value based on at least one comparison data and the reference data REF. The reference data REF[M−1:0] may include M bits in a manner similar to the first comparison data $D_1[N-1:N-M]$ and the second comparison data $D_2[N-1:N-M]$.

The comparing unit 230 may transfer control data D[N] to the output unit 240 (e.g., an output circuit). The output unit 240 may allow second pixel data $D_2[N-1:0]$ to be combined with the control data D[N], and thus may generate second source data $D_2[N:0]$ and may output the second source data. In at least one example embodiment, the control data D[N] may be 1-bit digital data, and a most significant bit of the second source data $D_2[N:0]$ may be the control data D[N], thus, the second source data $D_2[N:0]$ may be N+1-bit digital data. However, the example embodiments are not limited thereto, and the control data may be any number of bits.

The control data D[N] generated by the comparing unit 230 may be determined according to a result of comparing the reference data REF[M−1:0] with the first comparison data $D_1[N-1:N-M]$ and the second comparison data $D_2[N-1:N-M]$. In at least one example embodiment, the comparing unit 230 may determine the control data $D_2[N]$ as a high logic value, when one of the first comparison data $D_1[N-1:N-M]$ and the second comparison data $D_2[N-1:N-M]$ is larger than the reference data REF[M−1:0], and the other is smaller than the reference data REF[M−1:0]. On the other hand, when the first comparison data $D_1[N-1:N-M]$ and the second comparison data $D_2[N-1:N-M]$ are both larger than or both smaller than the reference data REF[M−1:0], the comparing unit 230 may determine the control data D[N] as a low logic value.

In at least one example embodiment, the reference data REF[M−1:0] may be digital data corresponding to an intermediate voltage. The intermediate voltage may be higher than a ground voltage, and may be lower than a power supply voltage. When the first comparison data $D_1[N-1:N-M]$ is larger than the reference data REF[M−1:0] and the second comparison data $D_2[N-1:N-M]$ is smaller than the reference data REF[M−1:0], a source driver may perform a recycle operation some time after a second period begins. On the other hand, when the first comparison data $D_1[N-$ 1:N−M] is smaller than the reference data REF[M−1:0] and the second comparison data $D_2$[N−1:N−M] is larger than the reference data REF[M−1:0], a source driver may perform a precharge operation some time after a second period begins. In other words, the display controller 200 may generate control signals to control the source driver to perform the recycle operation and/or the precharge operation based on the first comparison data, the second comparison data, and the reference data.

A source driver in at least one example embodiment of the inventive concepts may determine whether to perform a precharge and/or recycle operation during a second period by referring to a value of a most significant bit of the second source data $D_2$[N:0] transmitted and/or transferred by the display controller 200. Thus, an analog circuit for determining whether to perform a precharge and/or recycle operation is not required to be included in a source driver internal, so the circuit area of the display driving apparatus may be smaller and the power consumption of the display driving apparatus may be reduced.

Figure 5:
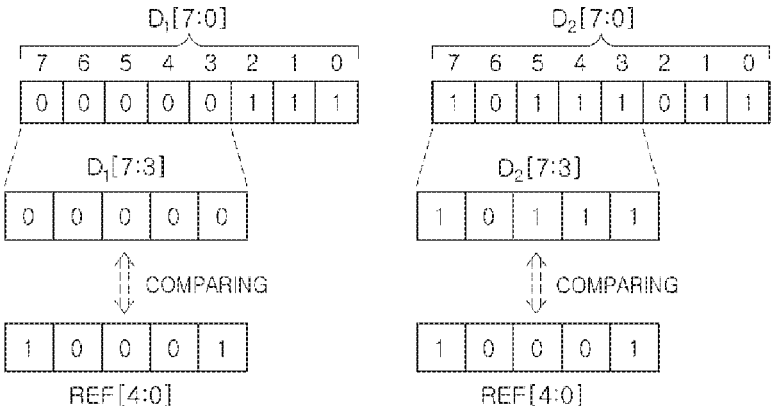
FIGS. 5 through 7 are views provided to illustrate an operation of a display controller according to at least one example embodiment.
Figure 6:
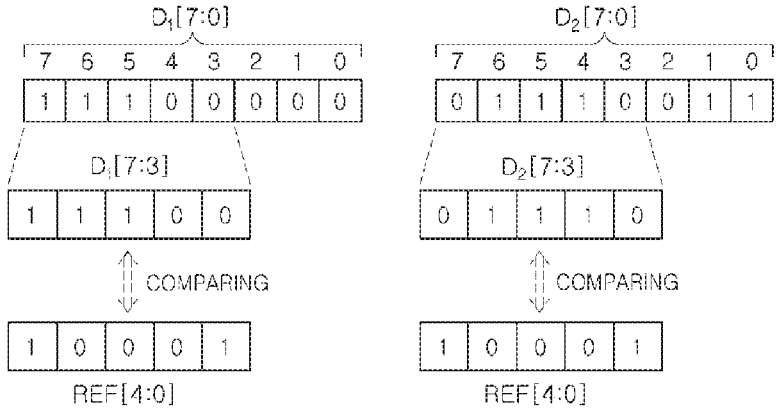
Figure 7:
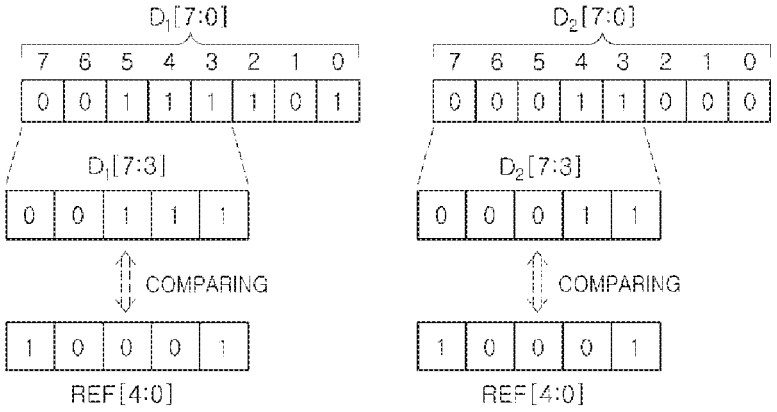

FIGS. 5 through 7 are views provided to illustrate an operation of a display controller according to at least one example embodiment. In at least one example embodiment illustrated in FIGS. 5 through 7, pieces of pixel data may be 8-bit digital data, and pieces of comparison data and reference data may be 5-bit digital data. However, this is merely an example, and the number of bits of pieces of pixel data, pieces of comparison data, and reference data may be variously modified. On the other hand, example embodiments illustrated with reference to FIGS. 5 through 7 may be performed by a display controller.

In example embodiments illustrated in FIGS. 5 through 7, a display controller may select five significant bits from each of first pixel data $D_1$[7:0] and second pixel data $D_2$[7:0], and then may generate first comparison data $D_1$[7:3] and second comparison data $D_2$[7:3]. The first comparison data $D_1$[7:3] and the second comparison data $D_2$[7:3] may be compared with reference data REF[4:0].

In at least one example embodiment illustrated in FIG. 5, the first comparison data $D_1$[7:3] may be smaller than the reference data REF[4:0], and the second comparison data $D_2$[7:3] may be larger than the reference data REF[4:0]. Thus, a display controller may determine control data as a high logic value, and a source driver may perform a precharge and/or recycle operation based on control data having a high logic value. In at least one example embodiment illustrated in FIG. 5, a precharge operation may be performed by a source driver.

Next, in at least one example embodiment illustrated in FIG. 6, the first comparison data $D_1$[7:3] may be larger than the reference data REF[4:0], and the second comparison data $D_2$[7:3] may be smaller than the reference data REF[4:0]. Thus, a display controller may determine control data as a high logic value, and a source driver may perform a precharge and/or recycle operation. However, in a manner different from at least one example embodiment illustrated in FIG. 5, in the case of at least one example embodiment illustrated in FIG. 6, a recycle operation may be performed by a source driver.

The source driver may perform a precharge and/or recycle operation by inputting an intermediate voltage corresponding to the reference data REF[4:0] to a source line. In at least one example embodiment illustrated in FIG. 5, as the first comparison data $D_1$[7:3] is smaller than the reference data REF[4:0], a precharge operation may be performed by an intermediate voltage input to a source line. On the other hand, in at least one example embodiment illustrated in FIG. 6, as the first comparison data $D_1$[7:3] is larger than the reference data REF[4:0], a recycle operation may be performed by an intermediate voltage input to a source line.

Next, in at least one example embodiment illustrated in FIG. 7, the first comparison data $D_1$[7:3] and the second comparison data $D_2$[7:3] may be smaller than the reference data REF[4:0]. Thus, a display controller may determine control data as a low logic value, and a source driver may not perform a precharge and/or recycle operation. In other words, a source driver may not input an intermediate voltage to a source line, and may directly input a second source voltage generated from the second comparison data $D_2$[7:3] to a source line.

Figure 8:
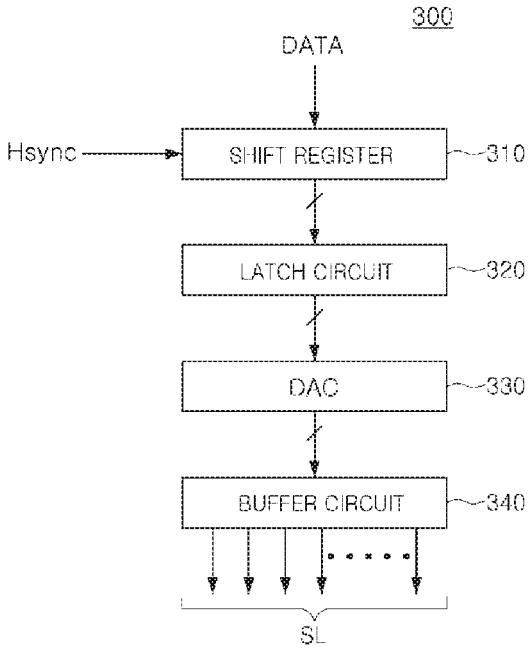
FIG. 8 is a block diagram schematically illustrating a source driver included in a display driving apparatus according to at least one example embodiment.

FIG. 8 is a block diagram schematically illustrating a source driver included in a display driving apparatus according to at least one example embodiment.

With reference to FIG. 8, a source driver 300 according to at least one example embodiment may include a shift register 310, a latch circuit 320, a digital-to-analog converter 330, a buffer circuit 340, and the like. In at least one example embodiment, the latch circuit 320 may include a sampling circuit sampling data and a holding latch storing data sampled by the sampling circuit. Each of the components 310 to 340 included in the source driver 300 is not limited to the at least one example embodiment illustrated in FIG. 8, and may be variously modified in other forms.

The shift register 310 may control operation timing of each of a plurality of sampling circuits included in the latch circuit 320 in response to a horizontal synchronization signal Hysnc. The horizontal synchronization signal Hysnc may be a signal having a desired (and/or predetermined) period. The latch circuit 320 may sample and store digital image data DATA according to a shift order of the shift register 310. The latch circuit 320 may output the digital image data DATA to the digital-to-analog converter 330.

The digital-to-analog converter 330 may convert the digital image data DATA into a source voltage. In at least one example embodiment, a source voltage generated by the digital-to-analog converter 330 may be output to a plurality of source lines SL via the buffer circuit 340. The source voltage output to the plurality of source lines SL may be input to a pixel connected to a gate line driven by a gate driver.

The buffer circuit 340 may include a plurality of buffers implemented as an operational amplifier, and the plurality of buffers may be connected to the plurality of source lines SL through a plurality of pads. In other words, a switch element, a capacitor, and the like, included in each pixel may be connected to an output terminal of each of the plurality of buffers, with one of source lines SL. Thus, when the resolution of a display device is increased, the load and time constants of a buffer output terminal may be increased. As the load and time constants of the buffer output terminal are increased, a slew time required to increase or reduce the output of a buffer to a source voltage may increase.

When the slew time of the buffer is increased, the amount of time in which a capacitor, or the like, included in a pixel within a period of the horizontal synchronization signal Hysnc is charged by a source voltage may be reduced, which may lead to quality degradation of an image displayed by a display device. To solve this problem, a buffer is driven with a high current, so slew time may be reduced. However, if the buffer is driven with a high current (or higher current), the power consumption of a display device increases, thus causing energy consumption and/or energy efficiency issues.

To solve the problem described above, an analog circuit for implementing precharge and recycle operations may be added inside the source driver 300. However, as the analog circuit is added to the source driver 300, a problem in which the power consumption and the circuit area of the source driver 300 are increased may occur.

In at least one example embodiment of the inventive concepts, a display controller may determine whether to pier form, precharge and recycle operations in a digital domain. Thus, while increases in power consumption and a circuit area of the source driver 300 are significantly reduced in comparison to including the analog circuit for precharge and recycle operations in a source driver, precharge and recycle operations are still implemented. In addition, degradation of an image quality caused by an increase in resolution of a display device may be reduced and/or suppressed.

Figure 9:
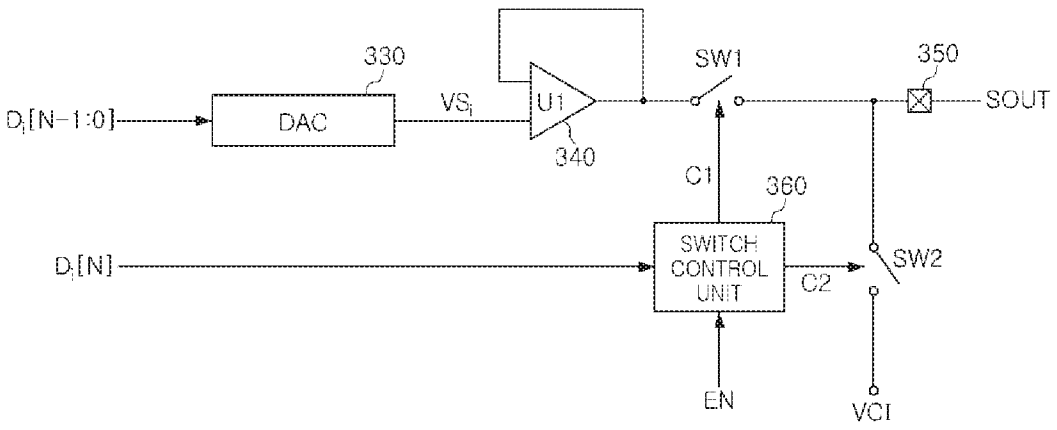
FIG. 9 is a circuit diagram provided to illustrate an operation of a source driver included in a display driving apparatus according to at least one example embodiment.
Figure 10:
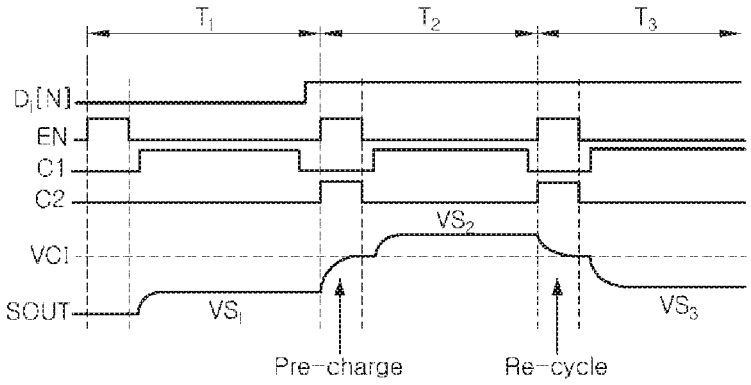
FIG. 10 is a timing diagram provided to illustrate an operation of a source driver according to FIG. 9.

FIG. 9 is a circuit diagram provided to illustrate an operation of a source driver included in a display driving apparatus according to at least one example embodiment, and FIG. 10 is a timing diagram provided to illustrate an operation of a source driver according to the at least one example embodiment illustrated in FIG. 9. Hereinafter, an operation of a source driver according to at least one example embodiment will be described with reference to FIGS. 9 and 10.

First, with reference to FIG. 9, a source driver according to at least one example embodiment may include a digital-to-analog converter 330, a buffer circuit 340, a pad 350, and a switch control unit 360 (e.g., a switch controller, a switch control circuit, etc.), but is not limited thereto. The switch control unit 360 may generate a first switch control signal C1 and a second switch control signal C2 for controlling a first switch SW1 connected between an output terminal of the buffer circuit 340 and the pad 350, and a second switch SW2 connected between an output terminal of the intermediate voltage VCI and the pad 350. The buffer circuit 340 may include an operational amplifier U1.

The digital-to-analog converter 330 may receive pixel data $D_i$[N−1:0] from a latch circuit. The pixel data $D_i$[N−1:0] may be N-bit digital data corresponding to the source voltage $VS_i$ which a source driver should output during each period. The pixel data $D_i$[N−1:0] may correspond to the source voltage $VS_i$ output through a source line when i-th gate line is driven.

Meanwhile, the control data $D_i$[N] transferred from a display controller with the pixel data $D_i$[N−1:0] may be transferred to the switch control unit 360. The control data $D_i$[N] may be 1-bit digital data, but is not limited thereto. The switch control unit 360 may be operated while an enable signal EN has a high value, and may determine a value of each of the first switch control signal C1 and the second switch control signal C2 as a high or low logic value depending on a value of the control data $D_i$[N].

In at least one example embodiment, when the control data $D_i$[N] has a high logic value, the switch control unit 360 sets the first switch control signal C1 as a low logic value, and sets the second switch control signal C2 as a high logic value. Thus, when the control data $D_i$[N] has a high logic value, the pad 350 is separated from an output terminal of the buffer circuit 340, and the intermediate voltage VCI is input to the pad 350, so an output SOUT of a source driver may be set as the intermediate voltage VCI.

With reference to a timing diagram of FIG. 10, a first source voltage $VS_1$ output by a source driver during a first period $T_1$ may be lower than the intermediate voltage VCI, and a second source voltage $VS_2$ output by a source driver during a second period $T_2$ may be higher than the intermediate voltage VCI. Thus, the control data $D_i$[N] may have a high logic value during the second period $T_2$, and the first switch SW1 may be turned-off and the second switch SW2 may be turned-on. Thus, while the switch control unit 360 is operated, the output SOUT of a source driver may be set as the intermediate voltage VCI.

In at least one example embodiment illustrated in FIG. 10, the first source voltage $VS_1$ may be lower than the intermediate voltage VCI. Thus, as the switch control unit 360 allows the first switch SW1 to be turned-off and the second switch SW2 to be turned-on at a portion of the beginning of the second period $T_2$, a precharge operation may be performed by the intermediate voltage VCI.

Meanwhile, the second source voltage $VS_2$ output by a source driver during the second period $T_2$ may be higher than the intermediate voltage VCI, and a third source voltage $VS_3$ output by a source driver during a third period $T_3$ may be lower than the intermediate voltage VCI. Thus, the control data $D_i$[N] may maintain a high logic value even during the third period $T_3$, and the first switch SW1 may be turned-off and the second switch SW2 may be turned-on while the switch control unit 360 is operated. As a result, as the output SOUT of a source driver is set as the intermediate voltage VCI, a recycle operation may be performed at a portion of the beginning of the third period $T_3$.

In display driving apparatus according to at least one example embodiment, whether to perform, a precharge and/or recycle operation may be determined by the control data $D_i$[N]. The control data $D_i$[N] may be digital data generated in advance in a display controller and transferred to a source driver. Thus, the source driver may not include an analog circuit for determining whether to perform a precharge and/or recycle operation, which will be compared and described with reference to FIGS. 11 and 12.

Figure 11:
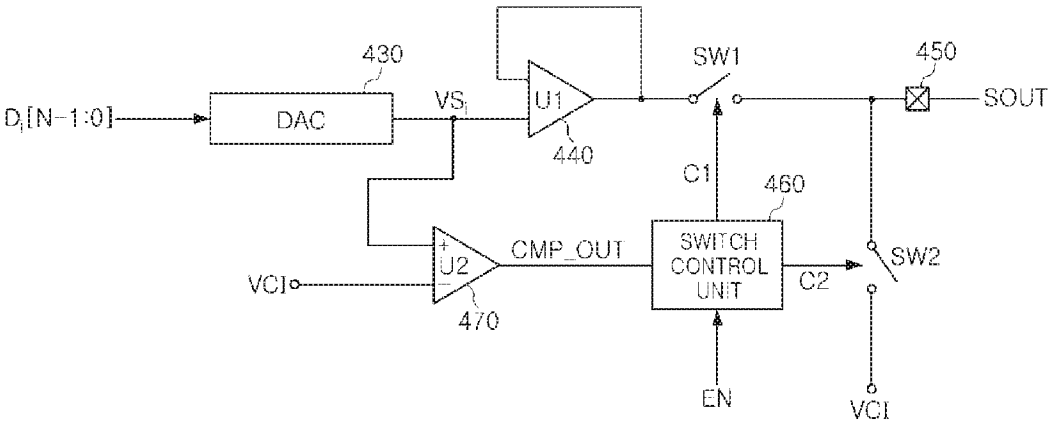
FIG. 11 is a circuit diagram provided to compare and illustrate the operation of a source driver according to FIG. 9.
Figure 12:
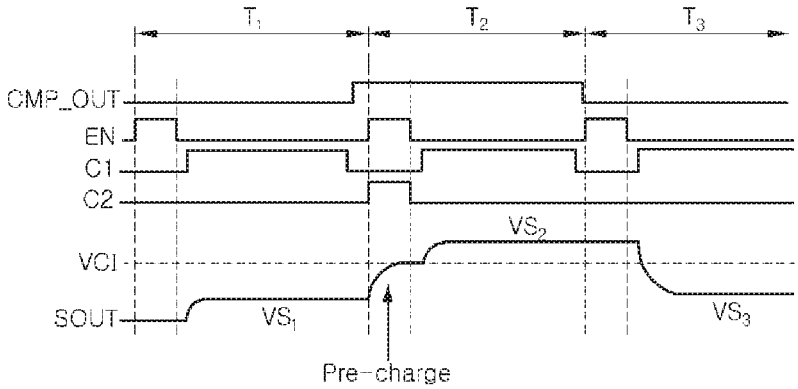
FIG. 12 is a timing diagram provided to illustrate an operation of a source driver according to FIG. 11.

FIG. 11 is a circuit diagram provided to compare and illustrate an operation of a source driver according to at least one example embodiment illustrated in FIG. 9, and FIG. 12 is a timing diagram provided to illustrate an operation of a source driver according to at least one example embodiment illustrated in FIG. 11.

A source driver illustrated in FIG. 11 may include a digital-to-analog converter 430, a buffer circuit 440, a pad 450, a switch control unit 460, and a comparator 470, but is not limited thereto. The switch control unit 460 may output a first switch control signal C1 and a second switch control signal C2, thereby controlling turning each of a first switch SW1 and a second switch SW2 on and off, or in other words, the switch control unit 460 may control a plurality of control switches by transmitting control signals. The first switch control signal C1 and the second switch control signal C2 may be determined by an output CMP_OUT of the comparator 470.

When comparing a circuit diagram of FIG. 11 with a circuit diagram of FIG. 9, the comparator 470 for comparing the source voltage $VS_i$ with the intermediate voltage VCI may be further included. The comparator 470 may include an operational amplifier U2 in a manner similar to the buffer circuit 440. Thus, a circuit illustrated in FIG. 11 may occupy more physical area and may consume more power in comparison to the circuit according to the at least one example embodiment illustrated in FIG. 9.

In addition, the circuit illustrated in FIG. 11 may provide only a precharge function, and may not provide a recycle function. With reference to the timing diagram of FIG. 12, the first source voltage $VS_1$ output by a source driver during the first period $T_1$ may be lower than the intermediate voltage VCI, and the second source voltage $VS_2$ output by a source driver during the second period $T_2$ may be higher than the intermediate voltage VCI. Thus, before the second period $T_2$ begins, the output CMP_OUT of the comparator 470 is set as (e.g., transitions to) a high logic value, so the first switch SW1 may be turned-off and the second switch SW2 may be turned-on. Moreover, a precharge operation for setting the output SOUT of a source driver as the intermediate voltage VCI may be performed.

On the other hand, the third source voltage $VS_3$ output by a source driver during the third period $T_3$ may be lower than the intermediate voltage VCI. Thus, the output CMP_OUT of the comparator 470 may be set as (e.g., transitions to) a low logic value before the third period $T_3$ begins. The second switch SW2 is turned-off by the output CMP_OUT of the comparator 470 set as a low logic value, and a recycle operation for connecting the output SOUT of a source driver to the intermediate voltage VCI may not be performed. Thus, power consumption of a display driving apparatus may increase. To solve the problems described above, the comparator 470 for performing a recycle operation may be further added. In this case, the circuit area and power consumption may be further increased.

On the other hand, a source driver according to the at least one example embodiment illustrated in FIG. 9 may determine whether precharge and/or recycle operations are required without a separate comparator 470 using an operational amplifier, or the like, thereby reducing power consumption. Moreover, whether precharge and/or recycle operations are required in a digital domain is determined without an increase in the number of comparators, e.g., the comparator 470, so not only the power consumption is reduced, but also the circuit area (e.g., physical area) may be reduced.

Figure 13:
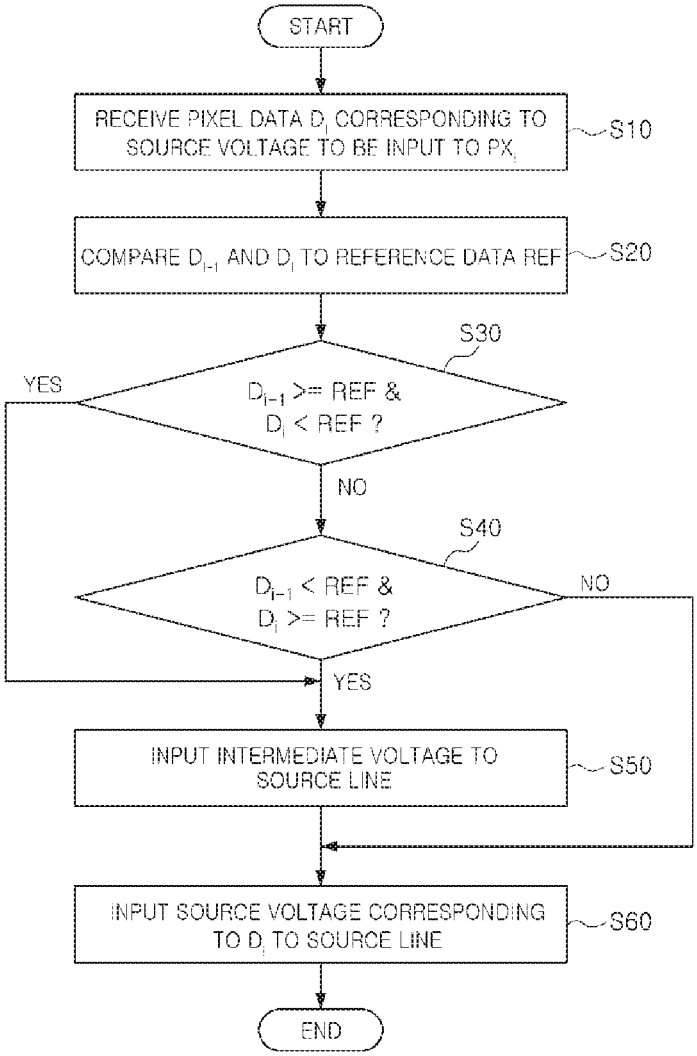
FIG. 13 is a flow diagram provided to illustrate an operation of a display driving apparatus according to at least one example embodiment.

FIG. 13 is a flow diagram provided to illustrate an operation of a display driving apparatus according to at least one example embodiment.

With reference to FIG. 13, an operation of a display driving apparatus according to at least one example embodiment may begin when a display controller receives i pixel data $D_i$ (S10). The i pixel data $D_i$ may correspond to a source voltage to be input to i pixel $PX_i$. The display controller may compare the i pixel data $D_i$ and i−1 pixel data $D_{i-1}$ with the reference data REF (S20). The i−1 pixel data $D_{i-1}$ may correspond to a source voltage input to i−1 pixel $PX_{i-1}$, and the i−1 pixel $PX_{i-1}$ and the i pixel $PX_i$ may be pixels sequentially connected to a single source line, but is not limited thereto.

The display controller may determine whether the i−1 pixel data $D_{i-1}$ is larger than or the same as the reference data REF, and whether the i pixel data $D_i$ is smaller than the reference data REF (S30). When the criteria in S30 are not satisfied, the display controller may determine whether the i−1 pixel data $D_{i-1}$ is smaller than the reference data REF, and the i pixel data $D_i$ is larger than or the same as the reference data REF (S40).

When one of the criteria in S30 and the criteria in S40 is satisfied, the display controller may control a source driver to perform a precharge and/or recycle operation. In at least one example embodiment, the display controller may input an intermediate voltage to a source line (S50), and the intermediate voltage may be input to the i pixel $PX_i$ through the source line. The intermediate voltage may be a voltage corresponding to the reference data REF, and the source line may be a line in which i−1 pixel $PX_{i-1}$ is connected to the i pixel $PX_i$, but the example embodiments are not limited thereto.

When the intermediate voltage is input to the source line in S50, a precharge and/or recycle operation may be performed depending on the relationship between the low and high levels of a source voltage input to the i−1 pixel $PX_{i-1}$ and the intermediate voltage. In at least one example embodiment, when a source voltage input to the i−1 pixel $PX_{i-1}$ is lower than the intermediate voltage, a precharge operation may be performed in S50. Meanwhile, when a source voltage input to the i−1 pixel $PX_{i-1}$ is higher than the intermediate voltage, a recycle operation may be performed in S50. When a precharge and/or recycle operation is completed, a source voltage corresponding to the i pixel data $D_i$ may be input to the source line (S60). The source voltage input in S60 may be input to the i pixel PXi.

Meanwhile, when all of the criteria in S30 and the criteria in S40 are not satisfied, the display controller may directly input a source voltage corresponding to the i pixel data $D_i$ to the source line without precharge and/or recycle operations (S60). In this case, all the i−1 pixel data $D_{i-1}$ and the i pixel data $D_1$ are smaller than the reference data REF, or all of the i−1 pixel data $D_{i-1}$ and the i pixel data $D_i$ are larger than the reference data REF.

Figure 14:
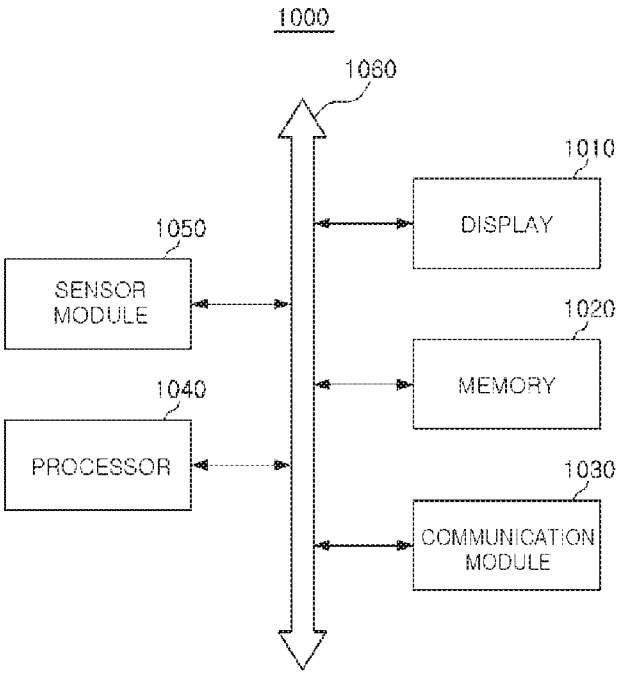
FIG. 14 is a block diagram illustrating an electronic device including a display device according to at least one example embodiment.

FIG. 14 is a block diagram illustrating an electronic device including a display device according to at least one example embodiment.

With reference to FIG. 14, an electronic device 1000 according to at least one example embodiment may include a display 1010, a memory 1020, a communication module 1030, a sensor module 1040, at least one processor 1050, and the like, but is not limited thereto. The electronic device 1000 may include a television, a desktop computer, a smart device, and the like, in addition to a mobile device such as a smartphone, a tablet PC, a laptop computer, a virtual reality device, an augmented reality device, and the like. A component such as the display 1010, the memory 1020, the communication module 1030, the sensor module 1040, the processor 1050, and the like may communicate each other through a bus 1060.

The display 1010 may include a display driving apparatus as described previously. In other words, when an abnormal power-off situation such as battery removal, power failure, or the like, occurs, the display 1010 may set a gate driving signal as one of gate power supply voltages during a desired (and/or predetermined) delay time. After the delay time has elapsed, the display 1010 naturally discharges a gate power supply voltage, thereby effectively removing a residual charge existing in a pixel through the display driving apparatus.

As set forth above, according to various example embodiments of the present inventive concepts, a display controller and a display driving apparatus may compare each of a first, source voltage input to a source line during a first period and a second source voltage input to a source line during a second period, subsequent to the first period with a desired (and/or predetermined) reference voltage to perform a precharge and/or recycle operation. As a source voltage is compared to a reference voltage in a digital domain, an area in which a display driving apparatus is located and power consumption may be reduced.

While various example embodiments have been, shown and described above, it will be apparent to those skilled in the art that modifications and variations could be made without departing from the scope of the inventive concepts, as defined by the appended claims.

What is claimed is:

1. A display controller comprising:

a buffer configured to store first pixel data input to a source line during a first period, and second pixel data input to the source line during a second period, the second period being subsequent to the first period; and a data generating circuit configured to, generate control data by comparing each of the first pixel data and the second pixel data with desired reference data, the desired reference data is digital data corresponding to an intermediate voltage, the intermediate voltage being lower than a power supply voltage and higher than a ground voltage, and transfer the second pixel data and the control data to a source driver driving the source line.

2. The display controller of claim 1, wherein each of the first pixel data and the second pixel data includes N-bit digital data, where N is a natural number; and the desired reference data includes M-bit digital data, where M is a natural number smaller than N.

3. The display controller of claim 2, wherein the data generating circuit is configured to:

select M number of significant bits from each of the first pixel data and the second pixel data; and compare the M number of significant bits from each of the first pixel data and the second pixel data with the desired reference data.

4. The display controller of claim 1, wherein the control data includes 1-bit digital data.

5. The display controller of claim 4, wherein the control data has a high logic value, in response to one of the first pixel data or the second pixel data being larger than the desired reference data and the other of the first pixel data and the second pixel data being smaller than the desired reference data.

6. The display controller of claim 5, wherein the display controller is configured to control the source driver to perform a precharge operation in response to the control data being set at the high logic value, the first pixel data being smaller than the desired reference data, and the second pixel data being larger than the desired reference data.

7. The display controller of claim 5, wherein the display controller is configured to control the source driver to perform a recycle operation in response to the control data being set at the high logic value, the first pixel data being larger than the desired reference data, and the second pixel data being smaller than the desired reference data.

8. The display controller of claim 4, wherein the control data has a low logic value, in response to the first pixel data and the second pixel data being larger than the desired reference data, or in response to the first pixel data and the second pixel data being smaller than the desired reference data.

9. The display controller of claim 1, wherein the data generating circuit is configured to generate source data by combining the control data with the second pixel data, and a most significant bit of the source data is the control data.

10. The display controller of claim 1, wherein the data generating circuit is configured to transfer the control data and the second pixel data to a shift register included in the source driver.

11. The display controller of claim 1, wherein the source driver is further configured to receive the intermediate voltage.

12. A display driving apparatus comprising:

a display controller configured to, compare each of first pixel data corresponding to a first source voltage and second pixel data corresponding to a second source voltage with reference data, and generate control data based on results of the comparison, wherein the first source voltage is input to a source line during a first period and a second source voltage is input to the source line during a second period, subsequent to the first period; and a source driver configured to input an intermediate voltage corresponding to the reference data to the source line during a portion of the second period, in response to the control data having a desired logic value.

13. The display driving apparatus of claim 12, wherein the source driver is configured to perform a precharge operation by inputting the intermediate voltage to the source line, in response to the control data having a high logic value and the first pixel data being smaller than the reference data.

14. The display driving apparatus of claim 12, wherein the source driver is configured to perform a recycle operation by inputting the intermediate voltage to the source line, in response to the control data having a high logic value and the first pixel data being larger than the reference data.

15. The display driving apparatus of claim 12, wherein the source driver includes:

a shift register configured to store pixel data corresponding to a source voltage to be input to the source line;

a digital-to-analog converter configured to convert the pixel data into the source voltage;

a buffer circuit configured to sample the source voltage;

a first switch connected between an output terminal of the buffer circuit and an input terminal of the source line;

a second switch connected between a node outputting the intermediate voltage and the input terminal of the source line; and a switch control circuit configured to turn the first switch off and turn the second switch on, in response to the control data having a high logic value.

16. A display driving apparatus comprising:

a display controller configured to, store first pixel data and second pixel data, the second pixel data received after the first pixel data, and generate control data related to a precharge operation or a recycle operation based on the first pixel data, the second pixel data, and desired reference data, the generating the control data including, generating a first result based on the first pixel data and the desired reference data, generating a second result based on the second pixel data and the desired reference data, determining whether to input the desired reference data to a source line based on the first result and the second result, and generating the control data based on results of the determination;

a source driver configured to receive the control data, and drive the source line based on the control data; and a display panel configured to output the second pixel data based on the source line.

17. The display driving apparatus of claim 16, wherein the first pixel data and the second pixel data are digital inputs; and the desired reference data corresponds to an intermediate voltage.

18. The display driving apparatus of claim 16, wherein the source driver is further configured to:

perform the precharge operation in response to the first result indicating that the first pixel data is less than the desired reference data and the second result indicating that the second pixel data is greater than or equal to the desired reference data, and the control data is high; and perform the recycle operation in response to the first result indicating that the first pixel data is greater than or equal to the desired reference data and the second result indicating that the second pixel data is less than the desired reference data, and the control data is high.

19. The display driving apparatus of claim 16, wherein the source driver is further configured to drive the source line based on the second pixel data.

* * * * *